US011185959B2

(12) United States Patent
Fang et al.

(10) Patent No.: US 11,185,959 B2
(45) Date of Patent: Nov. 30, 2021

(54) FLOCKING SANDING TOOL AND MANUFACTURING METHOD THEREOF

(71) Applicant: DongGuan Golden Sun Abrasives Co., Ltd., Dongguan (CN)

(72) Inventors: Hong Fang, Dongguan (CN); Zhongchao Nong, Dongguan (CN)

(73) Assignee: DongGuan Golden Sun Abrasives Co., Ltd., Dongguan (CN)

( * ) Notice: Subject to any disclaimer, the term of this patent is extended or adjusted under 35 U.S.C. 154(b) by 605 days.

(21) Appl. No.: 15/792,713

(22) Filed: Oct. 24, 2017

(65) Prior Publication Data

US 2019/0118342 A1 Apr. 25, 2019

(51) Int. Cl.

| | |
|---|---|
| ***B24D 11/00*** | (2006.01) |
| ***B24D 3/04*** | (2006.01) |
| ***B24D 11/02*** | (2006.01) |

(52) U.S. Cl.

CPC ..... *B24D 3/04* (2013.01); *B24D 11/001* (2013.01); *B24D 11/02* (2013.01)

(58) Field of Classification Search

CPC ..... B24D 3/04; B24D 11/02; B24D 11/001

USPC ..... 451/533, 534, 539; 51/293, 295, 297, 51/308

See application file for complete search history.

(56) References Cited

U.S. PATENT DOCUMENTS

| | | | | |
|---|---|---|---|---|
| 4,359,547 | A * | 11/1982 | Agarwal | C09J 157/00 524/500 |
| 5,109,638 | A * | 5/1992 | Kime, Jr. | B24D 11/02 451/539 |
| 2004/0038026 | A1* | 2/2004 | Li | B32B 15/08 428/354 |
| 2005/0095959 | A1* | 5/2005 | Sung | B24D 3/06 451/56 |
| 2012/0322351 | A1* | 12/2012 | Petersen | B24D 11/001 451/539 |
| 2015/0299944 | A1* | 10/2015 | Sugiura | D06N 3/14 428/137 |
| 2018/0157125 | A1* | 6/2018 | Yasui | B32B 27/00 |

* cited by examiner

*Primary Examiner* — Joseph J Hail
*Assistant Examiner* — Shantese L McDonald
(74) *Attorney, Agent, or Firm* — Raymond Y. Chan; David and Raymond Patent Firm

(57) ABSTRACT

A sanding tool includes a backing layer an adhesive layer and an abrasive layer. The adhesive layer is provided at the backing layer for bonding the abrasive layer at the backing layer via flocking techniques.

13 Claims, 6 Drawing Sheets

FLOCKING SANDING TOOL AND MANUFACTURING METHOD THEREOF

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to sanding tool, more particularly to a flocking sanding tool with improved features.

Description of Related Arts

A sanding tool, such as sandpaper, is commonly utilized in vehicle or electronic industry to abrade the surface thereof for different purposes. For example, the sandpaper can be used to remove material from a vehicle surface either to make it smooth for further painting, or sometimes to make the grinded surface rougher for a preparation of adding gluing layer.

FIG. 1 illustrates a conventional sandpaper which consists of three layers, including a backing layer 1A, a bonding layer 2A and an abrasive layer 3A. The bonding layer 2A is an intermediate layer for joining the abrasive layer 3A to the backing layer 1A, so as to form an laminated sandpaper. The abrasive layer 3A comprises a plurality of abrasive particles 30A outwardly protruded from the backing layer 1A in such a manner that when the sandpaper is adapted to scratch a surface, such as a surface of a vehicle, the abrasive particles 30A are frictionally moved with respective to the grinding surface for improving the surface feature thereof. However, there existing many shortcomings and disadvantages when applying the conventional sandpaper in practice.

In particular, the abrasive particles 30A, such as aluminum oxide or silicon carbide, are glued to the backing layer 1A via the bonding layer 2A at random, usually with high-density distribution at the conventional sandpaper. As such, in the process of grinding a metallic surface of a vehicle, the metallic particles removed from the grinded surface would be accumulated between the intervals of the abrasive particles 30A under the sandpaper and cause a clogging gradually thereby. As it is well known that the clogging would smoothen the abrasive layer, thus the grinding property thereof is weakened substantially.

Further, the friction formed between the sandpaper and the grinding surface is a totally dry friction, where a large amount of heat would generate correspondingly. The conventional sandpaper has a bad heat dissipation performance because of the clogging and the material of sandpaper. In particular, the clogging, caused between the grinding surface and the sandpaper, would tighten the contact between the sandpaper and the grinding surface, such that a gap defined therebetween is smaller and the heat-dissipating passage is clogged to some extent. Moreover, there is no such dry lubricant or the like adding to the conventional sandpaper for improving the friction between the sandpaper and the grinding surface.

Moreover, since the heat generated between the grinding surface and the sandpaper cannot be dissipated in time, the accumulated heat would not only damage the grinding surface but also affect the sandpaper.

Accordingly, when the heat is generated and accumulated on the grinding surface, such as a vehicle surface, the vehicle surface would be burnt, causing a great deal of loss. As we all known that the vehicle surface is a fine product, even a burned spot would ruin the whole product. On the other hand, the heat assembled under the sandpaper would melt the bonding layer 2A in some conventional sandpaper products, since the material of the bonding layer 2A cannot withstand the heat generated during machine sanding.

In addition, the material removed from the grinding surface via the sandpaper becomes dust which flies at random at anywhere, which not only damage people's health but also cause a great trouble to clean up.

Therefore, a need for providing an improved sandpaper with better performance especially anti-clogging, better heat dissipation feature and dustproof, is existed and strong.

SUMMARY OF THE PRESENT INVENTION

The invention is advantageous in that it provides a flocking sanding tool and manufacturing method thereof, wherein the sanding tool has a better anti-clogging and heat-dissipation performance.

Another advantage of the invention is to provides a flocking sanding tool and manufacturing method thereof, wherein the sanding tool comprises a backing layer, an adhesive layer attached to the backing layer for retaining an abrasive layer thereon, wherein the abrasive layer are flocked at the backing layer via a flocking techniques.

Another advantage of the invention is to provide a flocking sanding tool and manufacturing method thereof, wherein the abrasive particles are evenly distributed on the backing layer by the flocking techniques with even gaps formed between each two abrasive particles. Therefore, the sanding tool of the present invention has a better heat dissipation performance and anti-clogging feature.

Another advantage of the invention is to provide a flocking sanding tool and manufacturing method thereof, wherein the adhesive layer is a compound layer, comprising a water-based adhesive, a leveling agent and a solidifying agent.

Another advantage of the invention is to provide a flocking sanding tool and manufacturing method thereof, wherein the adhesive layer comprises a water-based adhesive to withstand the relative high temperature during sanding process, so as to prolong the life span of the sanding tool thereby.

Another advantage of the invention is to provide a flocking sanding tool and manufacturing method thereof, wherein the material removed from the sanding surface will be washed away from the grinding surface because of the material property of the sanding tool, so as to prevent clogging and enhance a heat dissipation.

Another advantage of the invention is to provide a flocking sanding tool and manufacturing method thereof, wherein the backing layer is a multi-layer, comprising a web base, backing cloth, and adhesion medium, which is flexible enough to adapt for irregular contours of a workpiece.

Another advantage of the invention is to provide a flocking sanding tool and manufacturing method thereof, wherein the sanding tool has a better heat dissipation ability to prevent the grinding surface being burnt during sanding process.

Another advantage of the invention is to provide a flocking sanding tool and manufacturing method thereof, wherein the manufacturing method of the sanding tool of the present invention is normal and simple, such that the cost of the sanding tool is less.

Another advantage of the invention is to provide a flocking sanding tool and manufacturing method thereof, wherein no expensive or complicate structure is required to employ in the present invention. Therefore, the present invention successfully provides an economic and efficient solution for providing a sanding tool with better performance.

Additional advantages and features of the invention will become apparent from the description which follows, and may be realized by means of the instrumentalities and combinations particular point out in the appended claims.

According to the present invention, the foregoing and other objects and advantages are attained by a sanding tool which comprises:

a backing layer;

an adhesive layer; and an abrasive layer, wherein the adhesive layer is provided on the backing layer for bonding the abrasive layer at the backing layer via flocking techniques.

According to one or more embodiments of the present invention, wherein the backing layer further comprises a web base, an adhesion medium and a backing cloth, wherein the adhesion medium is provided between the web base and the backing cloth to couple the web base and the backing cloth together.

According to one or more embodiments of the present invention, wherein the abrasive layer is flocked on the backing layer and supported on the backing cloth thereof.

According to one or more embodiments of the present invention, wherein the web base is made of a material selected from the group of natural fiber, artificial fiber and rubber.

According to one or more embodiments of the present invention, wherein the adhesive layer is made of an adhesive compound comprising a water-based adhesive, a leveling agent and a solidifying agent.

According to one or more embodiments of the present invention, wherein the weight ratio of the water-based adhesive, the leveling agent and the solidifying agent is 85-103: 1: 1.5-2 in sequence.

According to one or more embodiments of the present invention, wherein the abrasive layer further comprises a plurality of abrasive particles outwardly protruded from the backing layer with a even distribution via flocking techniques.

According to one or more embodiments of the present invention, wherein the adhesive medium of the backing layer is made of the same material with that of the adhesive layer.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 2:
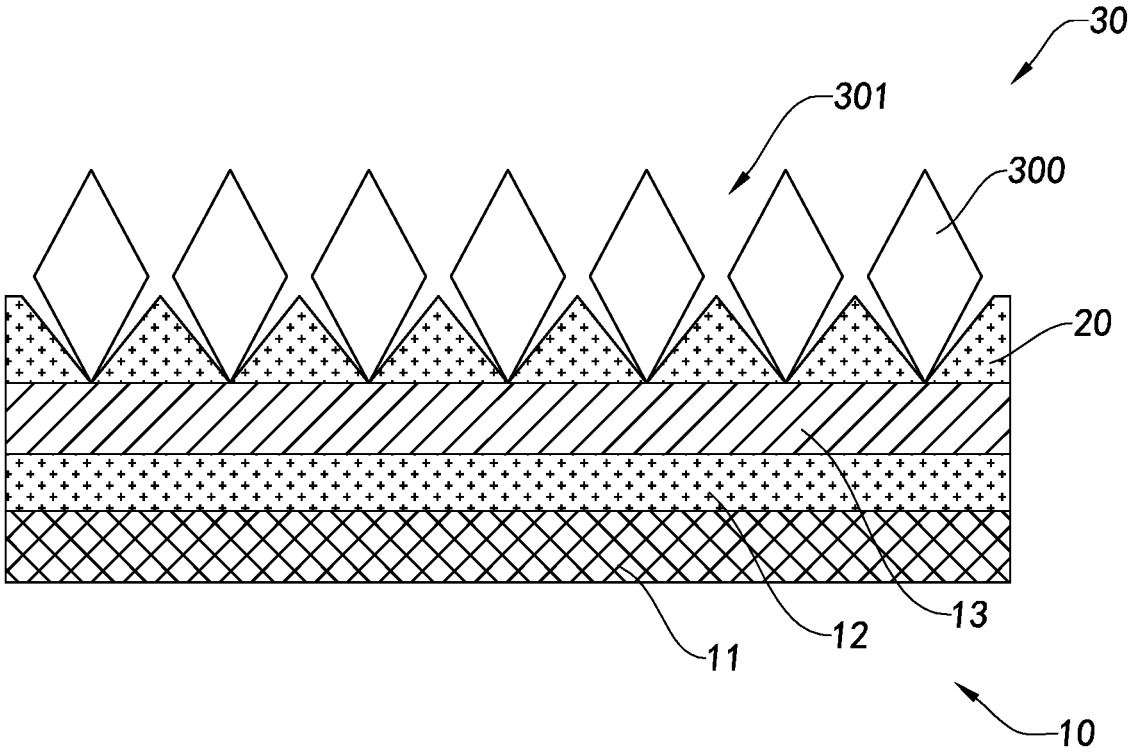
FIG. 2 is a schematic view of a sanding tool according to a first preferred embodiment of the present invention.
Figure 3:
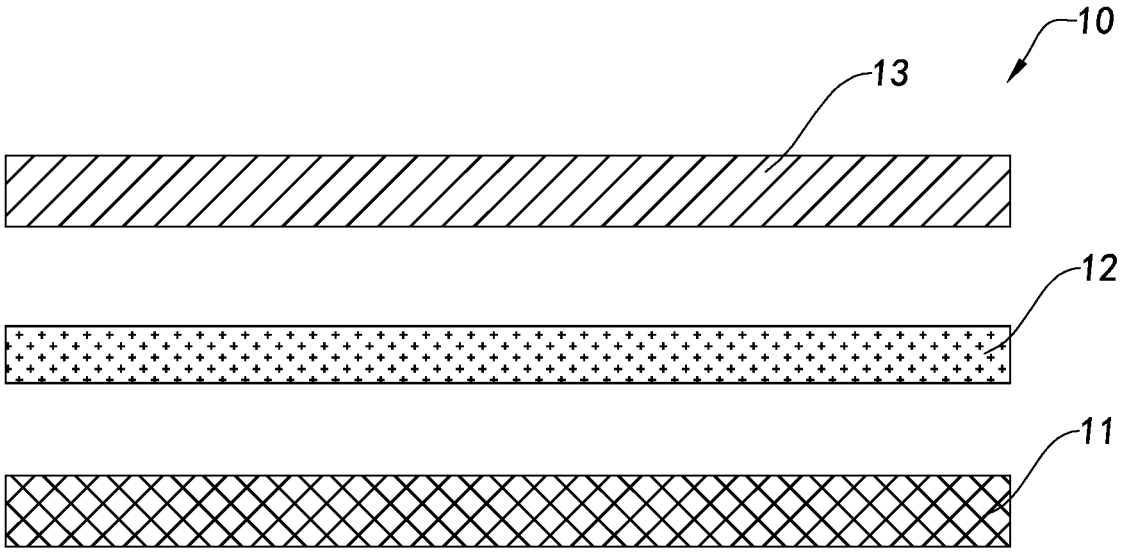
FIG. 3 is a schematic view of a backing layer of the sanding tool according to the above first preferred embodiment of the present invention.
Figure 4:
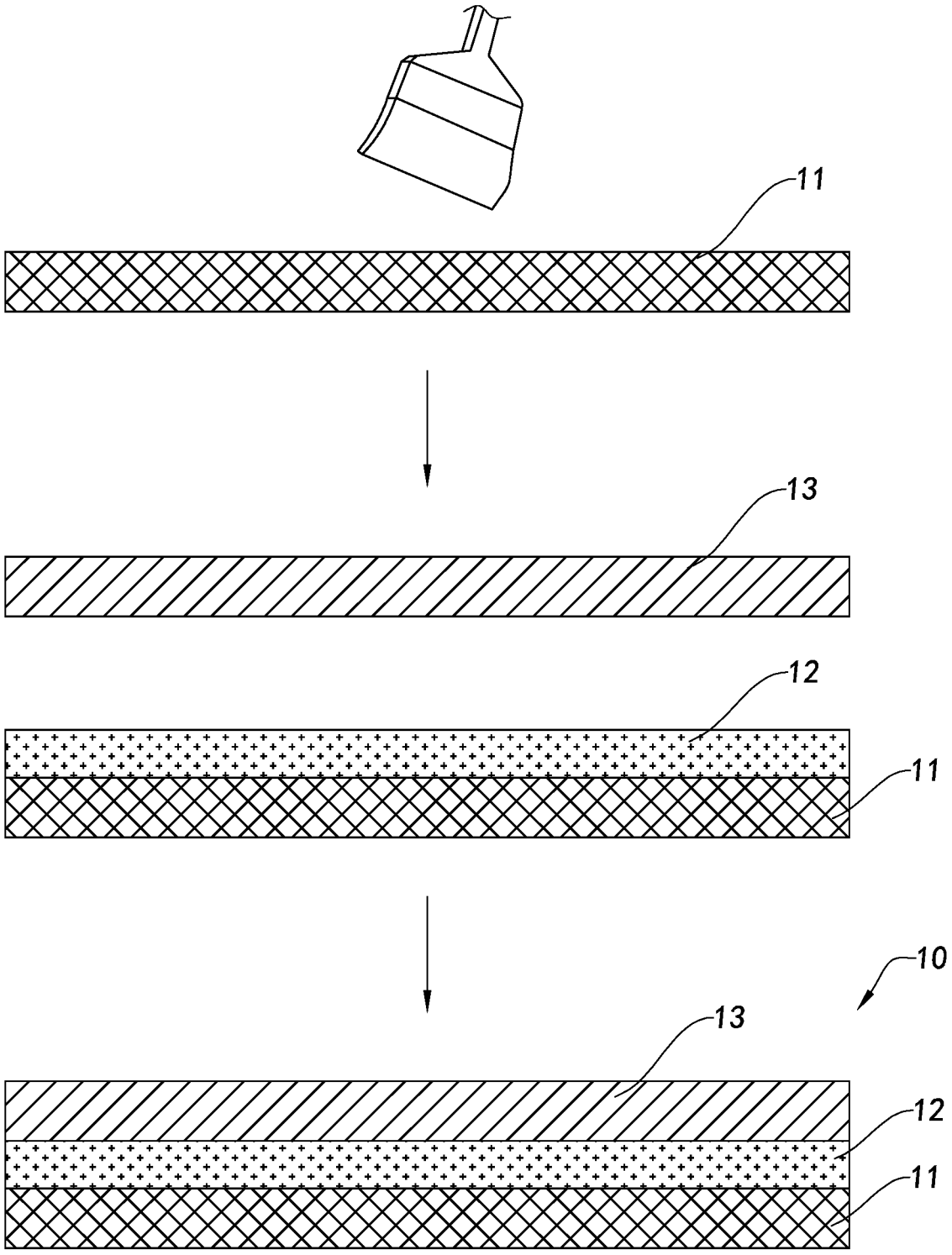
FIG. 4 is a schematic view illustrating a manufacturing step of forming the backing layer of the sanding tool of the present invention.
Figure 5:
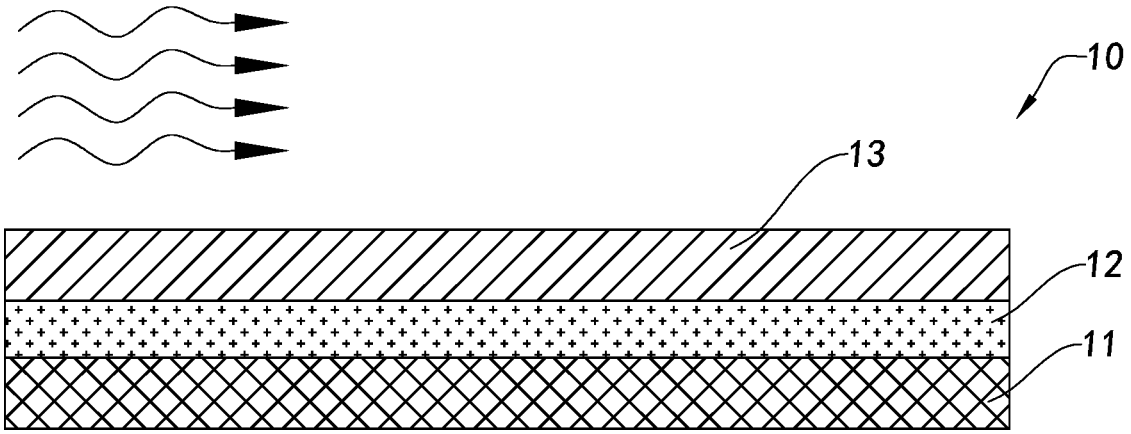
FIG. 5 is a sectional view illustrating another manufacturing step of drying the backing layer of the sanding tool of the present invention.
Figure 6:
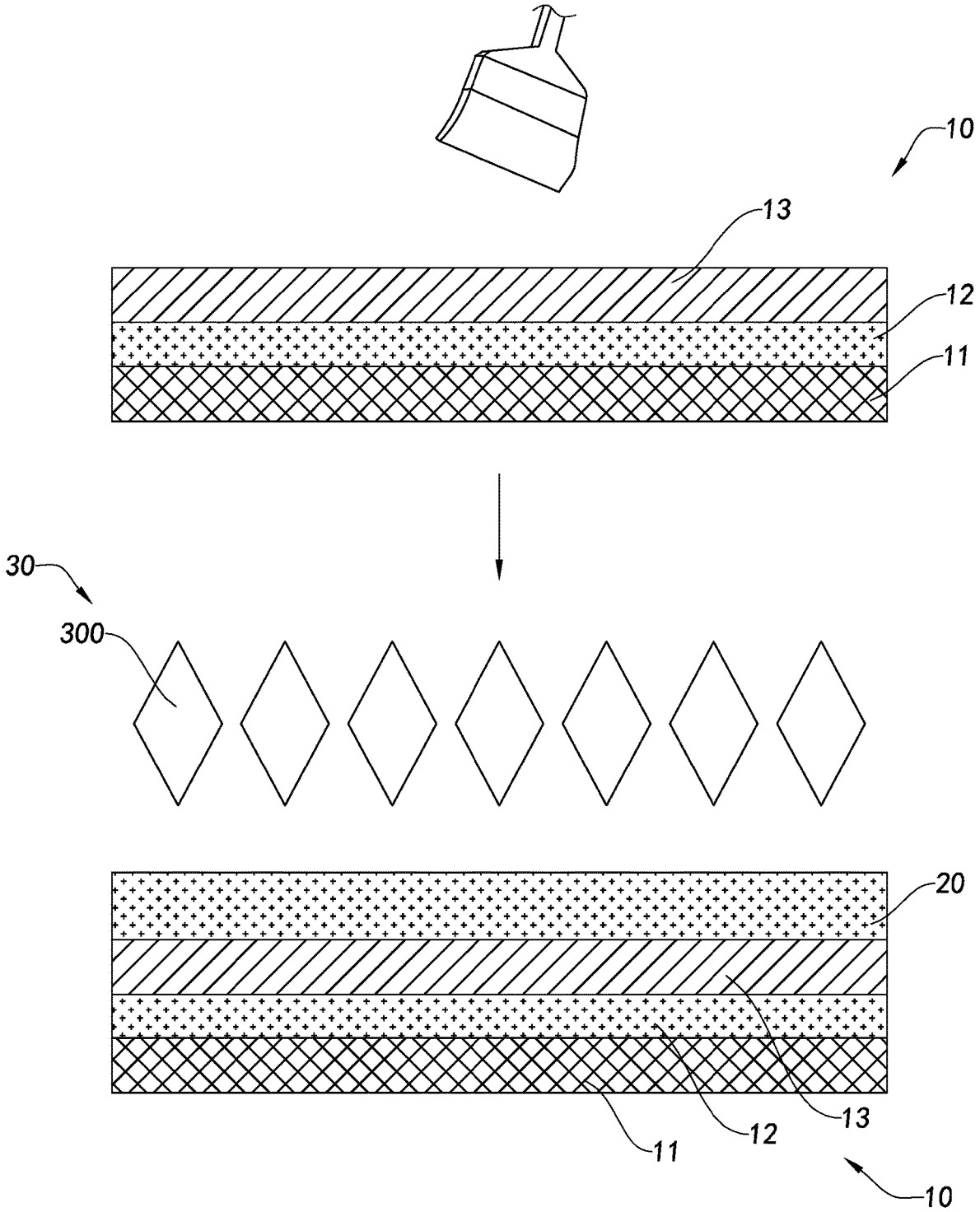
FIG. 6 is a sectional view illustrating another manufacturing step of forming the adhesive layer and flocking the abrasive layer of the sanding tool of the present invention.
Figure 7:
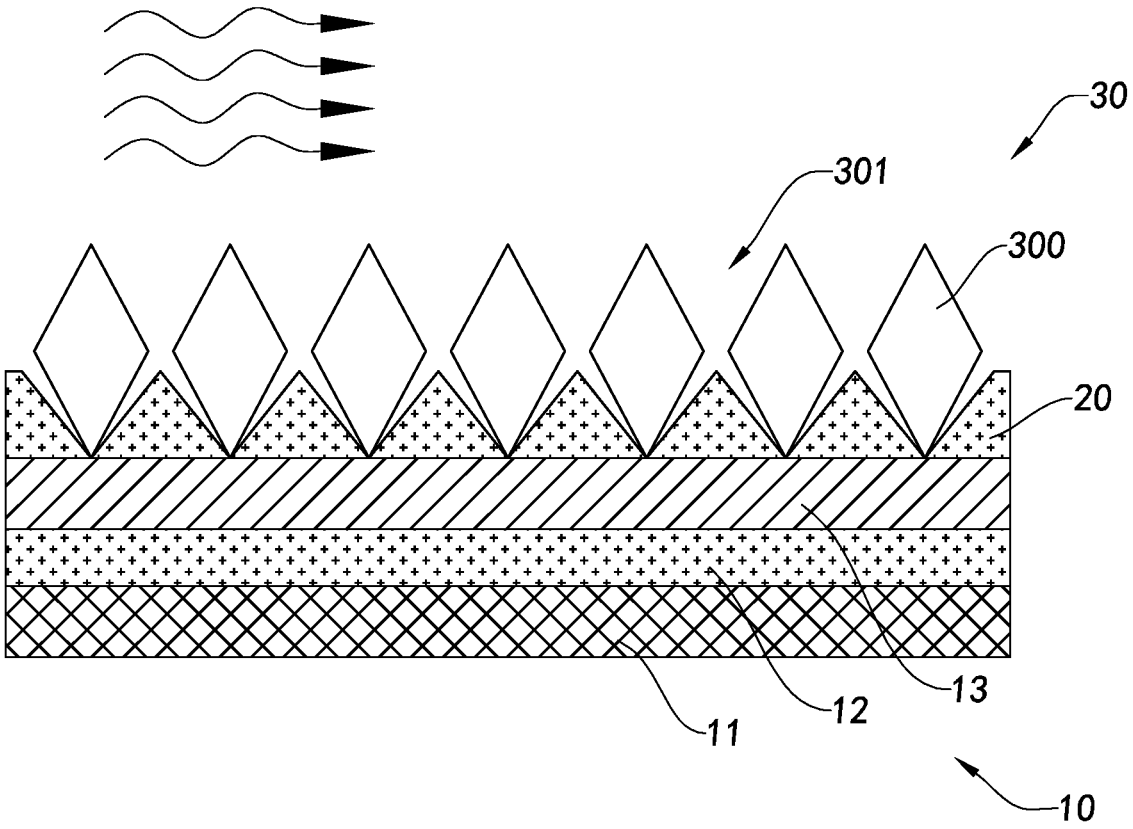
FIG. 7 is a sectional view illustrating another manufacturing step of drying and shaping the sanding tool of the sanding tool of the present invention

Referring to FIG. 2 and FIG. 3 of the drawings, a sanding tool according to a first preferred embodiment of the present invention is illustrated, wherein the sanding tool can be adapted in many areas, such as vehicle industry and electronic industry, for surface treatment. For example, the sanding tool can be utilized to remove material from a vehicle surface for further painting or other purposes.

As shown in FIG. 2, the sanding tool comprises a backing layer 10, an adhesive layer 20 and an abrasive layer 30, wherein the adhesive layer 20 is provided on the backing layer 10 for bonding the abrasive layer 30 thereat. That is to say, the adhesive layer 20 is a layer formed between the abrasive layer 30 and the backing layer 10 for joining them together into a multi-layer product. During use, the abrasive layer 30 is contacted with a grinding surface, such as a vehicle surface, to remove the materials of the grinding surface by the friction effect therebetween.

In the preferred embodiment of the present invention, the abrasive layer 30 is mounted onto the backing layer 10 via a flocking technique. Those who skilled in the art would know that the flocking is a process of depositing many small fiber particles onto a surface in a predetermined pattern. In other words, the distribution of the abrasive layer 30 practices can be predetermined in the present invention, since the abrasive layer 30 is flocked onto the backing layer 10.

In particular, the abrasive layer 30, in this preferred embodiment of the present, is evenly assembled on the backing layer 10, wherein an even storage gap 301 is formed between each two abrasive particles 300, such that during sanding process, the materials removed from the grinding surface will partially stored within the storage gaps. Therefore, the sanding tool of the present invention has a better dust-proof ability.

Further, the distribution density of the abrasive particles 300 which are outwardly protruded from the backing can be pre-designed according to a specific need. Compared with the conventional sandpaper with high-density of abrasive particles 300, the abrasive layer 30 has a larger gap formed between each two abrasive particles 300. Therefore, the material removed from the grinding surface will not fill the intervals formed between the abrasive particles 300, so as to prevent clogging during sanding process. Furthermore, since the clogging is substantially reduced in practice, the heat dissipation is enhanced thereby accordingly.

It is important to mention that the abrasive particle of the abrasive layer 30 can be made of different materials, i.e. emery, aluminum oxide, silicon carbide and so on. Moreover, the grit size of the abrasive particle and the storage gap 301 between each two abrasive particles 300 can be selected according to a specific need, which would not be a limit in the present invention.

Further, the adhesive layer 20, in this preferred embodiment of the present invention, is made from compound adhesion material. In particular, the material of the adhesive layer 20 comprises a water-based adhesive, a leveling agent, and a solidifying agent, which are mixed together.

In other words, in this preferred embodiment of the present invention, the adhesive layer 20 is a mixture, thus the performance of the adhesive layer 20 is determined by the components comprising of the adhesive layer 20 material. In particular, the water-based adhesive, such as APU, allows the sanding tool of the present invention to has a waterproof ability while be able to withstand a relative higher temperature generated during sanding process. It worth mentioning that the water-based adhesive is a kind of—health-friendly adhesive, which would not damage the health of the operator while performing sanding process.

The leveling agent, such as silicone oil and PDMS, added into the adhesive layer 20 is to improve the property of the water-based adhesive, i.e. to reduce the surface tension force thereof, so as to enhance the homogeneity of the water-based adhesive. In addition, the solidifying agent, such as DETA, PDA and MPD, added into the adhesive layer 20 is a substance to enhance the solidifying reaction at a predetermined temperature. Accordingly, in this preferred embodiment, the added solidifying agent is to increase the solidifying temperature of the adhesive layer 20 so as to enhance the heat-resisting property of the adhesive layer 20.

It is important to mention that the water-based adhesive, the leveling agent and the solidifying agent are optimally mixed at a weight ratio of 100-103: 1: 1.5-3 in sequence for acquiring a satisfying effect.

Figure 1:
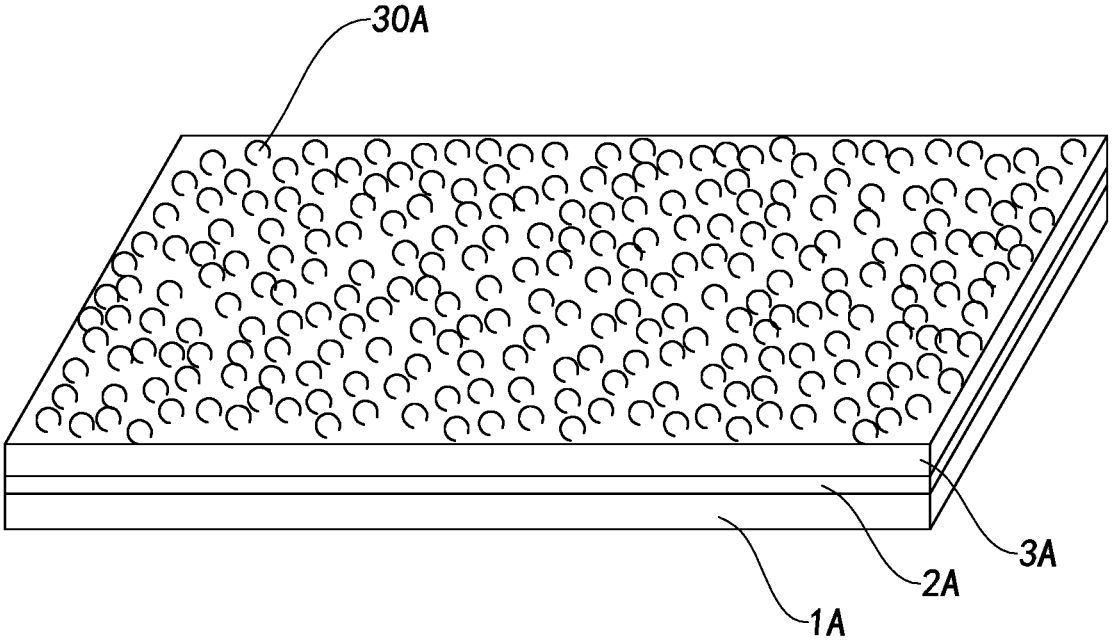
FIG. 1 is a schematic view of a sandpaper of the prior art.

As shown in FIG. 3 of the drawings, the backing layer 10, in this preferred embodiment, is a multi-layer, which comprises a web base 11, an adhesion medium 12 and a backing cloth 13. As shown in the FIG. 1, the adhesion medium 12 is disposed between the backing cloth 13 and the web base 11 for gluing the backing cloth 13 onto the web base 11 thereby. The backing cloth 13 is the uppermost layer of the backing layer 10 for supporting the abrasive layer 30. In other words, in this preferred embodiment of the invention, after the abrasive layer 30 is planted at the backing layer 10 via the adhesive layer 20 by the flocking techniques, the abrasive layer 30 is supported at the backing cloth 13 of the backing layer 10.

It worth mentioning that since the backing layer 10 of the present invention is a multi-layer, the strength of the backing layer 10 is quite increased as well as the flexibility ability thereof. More particularly, as we all known that just like the finishing net structure of the spider web structure, web structure is one of the most strengthened constructions. According, since the web base 11 (the lowermost layer of the backing layer 10) of the backing layer 10 has a web structure, the backing layer 10 is strengthened thereby for preventing the abrasive particles 300 penetrates through the backing layer 10 during sanding process. Moreover, the web structure has a good flexibility, thus, the sanding tool of the present invention is flexible enough to fit with irregular contours of a workpiece.

It is worth mentioning that the web base 11 of the backing layer 10 can be made of the material selected from the group of natural fiber, such as paper, artificial fiber, such as sponge, and rubber, which have a web structure.

In addition, the adhesive medium provided between the backing cloth 13 and the web base 11 provides a buffer function when the abrasive layer 30 acts on a grinding surface during use so as to prolong the lifespan of the sanding tool. In particular, the adhesive medium applied into the backing layer 10 can be made of the material same as that of the adhesive layer 20. That is to say that the adhesive medium of the backing layer 10 is made of compound adhesive material composing of a water-based adhesive, a leveling agent, and a solidifying agent. Likewise, the water-based adhesive and the leveling agent and the solidifying agent are optimally mixed at a weight ratio of 100-103: 1: 1.5-3 in sequence for acquiring a satisfying effect.

It is important to point out that since the adhesion provided at the backing layer 10 and the adhesive layer 20 is made of a same compound adhesive material, and thus, the manufacturing cost of the sanding tool of the present invention is quite decreased for the reason that you do not have to create two special adhesions for fulfilling the need of sanding tool, while the manufacturing process of the sanding tool is substantially simplified.

Referring to FIG. 4 to FIG. 7 of the drawings, a manufacturing method of the sanding tool is illustrated, wherein the manufacturing method comprises the steps of:

configuring an adhesion material;

configuring the backing layer 10 by applying the adhesion medium 12 at a web base 11 and overlapping a backing cloth 13 at the adhesion medium 12;

drying the backing layer 10 at a temperature ranged from 75° C. to 95° C. for about 20-30 minutes;

applying the adhesion material at the backing layer 10 at the backing cloth 13 thereof to form an adhesive layer 20 at the backing layer 10;

flocking an abrasive layer 30 at the backing layer 10; and shaping the sanding tool after being dried at a temperature ranged from 75° C. to 95° C. for about 20-30 minutes.

Accordingly, in the step of configuring an adhesion material, the adhesion material is a compound adhesive material comprising a water-based adhesive, a leveling agent and a solidifying agent, wherein an optimal mixture for these three components is 100-103: 1: 1.5-3 at a weight ratio in sequence.

In other words, the step of configuring an adhesion material, further comprises a step of:

mixing a water-based adhesive, a leveling agent and a solidifying agent at a weight ratio of 100-103: 1: 1.5-3 in sequence.

It is important to mention that the adhesion medium 12 of the backing layer 10 and the adhesive material forming the adhesive layer 20 is selected from the same adhesion material produced in the steps of configuring an adhesion material.

Moreover, in the step of flocking an abrasive layer 30, the abrasive particles 300 of the abrasive layer 30 is extended through the adhesive layer 20 and retained at the backing cloth 13 of the backing layer 10.

Accordingly, the step of flocking an abrasive layer 30, further comprises the steps of:

extending the abrasive particles 300 of the abrasive layer 30 through the adhesive layer 20;

contacting the abrasive particles 300 of the abrasive layer 30 with the backing cloth 13 of the backing layer 10; and retaining the abrasive particles 300 at the backing layer 10 via the adhesive layer 20.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A sanding tool, comprising:

a backing layer comprising a web base having a web structure, an adhesion medium and a backing cloth, wherein said adhesive medium is provided between said web base and said backing cloth to couple said web base and said backing cloth;

an adhesive layer; and an abrasive layer provided at said backing layer, wherein said abrasive layer is flocked onto said backing layer and is bonded at said backing layer via said adhesive layer, wherein said abrasive layer is extended through said adhesive layer and retained at said backing cloth of said backing layer.

2. A sanding tool, comprising:

a backing layer comprising a web base having a web structure, an adhesion medium and a backing cloth, wherein said adhesive medium is provided between said web base and said backing cloth to couple said web base and said backing cloth;

an adhesive layer; and an abrasive layer provided at said backing layer, wherein said abrasive layer is flocked onto said backing layer and is bonded at said backing layer via said adhesive layer, wherein said abrasive layer is flocked onto said backing layer after said adhesive layer is bonded on said backing layer, wherein said abrasive layer is extended through said adhesive layer and retained at said backing cloth of said backing layer, wherein said abrasive layer is extended through said adhesive layer and is contacted with said backing cloth of said backing layer without extending to said adhesive medium.

3. The sanding tool, as recited in claim 2, wherein said adhesive layer is made of an adhesive compound comprising a water-based adhesive, a leveling agent and a solidifying agent.

4. The sanding tool, as recited in claim 3, wherein a weight ratio for said water-based adhesive, said leveling agent and said solidifying agent is 85-103: 1: 1.5-2 in sequence.

5. The sanding tool, as recited in claim 4, wherein said abrasive layer further comprises a plurality of abrasive particles outwardly protruded from said backing layer and evenly distributed at said backing layer, wherein an even storage gap is formed between each two abrasive particles, wherein said abrasive particles of said abrasive layer are extended through said adhesive layer and are contacted with said backing cloth of said backing layer.

6. The sanding tool, as recited in claim 5 wherein said adhesive medium of said backing layer is made of same adhesion material of said adhesive layer.

7. The sanding tool, as recited in claim 6, wherein said web base is made of said material selected from said group of natural fiber, artificial fiber and rubber.

8. The sanding tool, as recited in claim 3, wherein said abrasive layer further comprises a plurality of abrasive particles outwardly protruded from said backing layer and evenly distributed at said backing layer, wherein an even storage gap is formed between each two abrasive particles, wherein said abrasive particles of said abrasive layer are extended through said adhesive layer and are contacted with said backing cloth of said backing layer.

9. The sanding tool, as recited in claim 5, wherein said adhesive medium of said backing layer is made of same adhesion material of said adhesive layer.

10. The sanding tool, as recited in claim 9, wherein said web base is made of said material selected from said group of natural fiber, artificial fiber and rubber.

11. The sanding tool, as recited in claim 2, wherein said abrasive layer further comprises a plurality of abrasive particles outwardly protruded from said backing layer and evenly distributed at said backing layer, wherein an even storage gap is formed between each two abrasive particles, wherein said abrasive particles of said abrasive layer are extended through said adhesive layer and are contacted with said backing cloth of said backing layer.

12. The sanding tool, as recited in claim 2, wherein said adhesive medium of said backing layer is made of same adhesion material of said adhesive layer.

13. The sanding tool, as recited in claim 2, wherein said web base is made of said material selected from said group of natural fiber, artificial fiber and rubber.

* * * * *